US012415553B2

(12) United States Patent
Aitken et al.

(10) Patent No.: US 12,415,553 B2
(45) Date of Patent: Sep. 16, 2025

(54) TRACTION ROD ASSEMBLY

(71) Applicant: Wabtec UK Limited, Staffordshire (GB)

(72) Inventors: William Alan Aitken, Leven (GB); Wayne Jamieson, Leven (GB); Robert James Wheeler, Heanor (GB)

(73) Assignee: Wabtec UK Limited, Staffordshire (GB)

( * ) Notice: Subject to any disclaimer, the term of this patent is extended or adjusted under 35 U.S.C. 154(b) by 946 days.

(21) Appl. No.: 17/528,748

(22) Filed: Nov. 17, 2021

(65) Prior Publication Data

US 2022/0185344 A1 Jun. 16, 2022

Related U.S. Application Data

(60) Provisional application No. 63/125,218, filed on Dec. 14, 2020.

(51) Int. Cl.
*B61F 5/50* (2006.01)

(52) U.S. Cl.
CPC ..... *B61F 5/50* (2013.01)

(58) Field of Classification Search
CPC ..... B61F 5/00; B61F 5/02; B61F 5/26; B61F 5/28; B61F 5/30; B61F 5/50; B61F 5/52
See application file for complete search history.

(56) References Cited

U.S. PATENT DOCUMENTS

| | | | | |
|---|---|---|---|---|
| 2,545,956 A | | 3/1951 | Alexandre | |
| 5,429,056 A | | 7/1995 | Pees et al. | |
| 10,035,524 B2 | * | 7/2018 | Nakao | B61F 5/52 |

FOREIGN PATENT DOCUMENTS

| | | | | |
|---|---|---|---|---|
| CH | 256397 A | | 8/1948 | |
| CN | 107074254 A | | 8/2017 | |
| DE | 1011912 B | | 7/1957 | |
| DE | 1014143 B | | 8/1957 | |
| DE | 1210450 B | | 2/1966 | |
| DE | 102014119689 A1 | | 6/2016 | |
| EP | 870664 A2 | * | 10/1998 | B61F 5/325 |

(Continued)

OTHER PUBLICATIONS

Office Action for corresponding EP Application No. 21213676.5 dated Feb. 1, 2024 (7 pages).

(Continued)

*Primary Examiner* — Robert J McCarry, Jr.

(74) *Attorney, Agent, or Firm* — K&L Gates LLP

(57) ABSTRACT

A traction rod assembly for a bogie system includes a body extending between first and second ends. A bush assembly is coupled with the first end and includes a first component having a passage, and a second component disposed within the passage of the first component. The bush assembly includes an eccentric offset such that a center of the first component is offset from a center of the second component. A bearing assembly is coupled with the second end of the body and includes cylindrical bearings and spacers that are concentric with a passage disposed at the second end of the body. The bush assembly is coupled with a frame of the bogie system and the bearing assembly is operably with an axle assembly of the bogie system. The bearing assembly allows rotation of the body relative to the axle assembly of the bogie system.

17 Claims, 12 Drawing Sheets

(56) References Cited

FOREIGN PATENT DOCUMENTS

| | | | | | |
|---|---|---|---|---|---|
| EP | 0879750 | A1 | | 11/1998 | |
| EP | 3222486 | A1 | | 9/2017 | |
| FR | 894717 | A | * | 1/1945 | ..... B60G 11/18 |
| FR | 923115 | A | | 6/1947 | |
| GB | 745299 | A | | 2/1956 | |
| JP | 2014194255 | A | | 10/2014 | |

OTHER PUBLICATIONS

Extended European Search Report for corresponding EP Application No. 21213676.6-1005 dated Apr. 21, 2022 (10 pages).
Chinese Office Action dated Jul. 7, 2024 for corresponding Chinese Application No. 202111524826.4.

* cited by examiner

TRACTION ROD ASSEMBLY

CROSS-REFERENCE TO RELATED APPLICATIONS

This application claims priority to U.S. Provisional Application No. 63/125,218, filed Dec. 14, 2020, which is incorporated by reference herein in its entirety.

BACKGROUND

Technical Field

The subject matter described relates to traction rod assemblies and methods of vehicle systems.

Discussion of Art

Bogies of vehicle systems include one or more traction bars or radial arms that structurally support suspension systems of the bogies. For example, a traction bar or arm may allow vehicle wheels to move vertically with respect to the body of the bogie while reducing an amount of movement of the wheels in forward and/or backwards directions (e.g., longitudinally), or side to side (e.g., laterally) relative to the frame of the bogie. FIG. 1 illustrates a partial perspective view of a bogie 10 that includes a front axle 12 and a rear axle 14, both operably coupled with a frame 16 of the bogie. The frame of the bogie extends between a front end 18 and a rear end 20 in a longitudinal direction, between a first side 22 and a second side 24 in a lateral direction, and between a top side 26 and a bottom side 28 in a vertical direction. In the illustrated embodiment, the bogie includes radial arms 30A, 30B that provide support to the suspension system of the bogie. The two radial arms 30A, 30B on the first side are shown in FIG. 1. The bogie also includes two radial arms on the second side that are not visible in FIG. 1. Each radial arm extends between an axle end 34 and a frame end 32. The axle end 34 of the radial arm 30B is operably coupled with the rear axle 14, and the frame end 32 of the radial arm 30B is operably coupled with the frame at a position between the first and second sides of the frame, and proximate the bottom side of the frame. For example, the frame end of each radial arm is coupled with the frame at a location underneath the frame body and between the first and second sides of the frame body.

Coupling the frame end of each radial arm with the bottom side of the frame, however, limits the overall height of the frame of the bogie system, and respectively, any cargo that the bogie may be carrying. For example, the bottom side of the frame must be disposed a distance away from a route (not shown) so as to provide enough clearance for the radial arms to be fixed to the bottom side of the frame. As the overall height of the bogie system increases, the stability of the bogie decreases as the bogie moves along the route.

It may be desirable to have a system and method that differs from those that are currently available.

BRIEF DESCRIPTION

In one or more embodiments, a traction rod assembly for a bogie system includes a body extending between a first end and a second end, and a bearing assembly coupled with the second end of the body. The bearing assembly includes cylindrical bearings and one or more spacers disposed between the cylindrical bearings along a bearing axis. The cylindrical bearings and the one or more spaces are concentric with a passage disposed at the second end of the body along the bearing axis. The first end of the body is coupled with a frame of the bogie system, and the bearing assembly is coupled with an axle assembly of the bogie system. The body is configured to rotate about the bearing axis relative to the axle assembly of the bogie system.

In one or more embodiments, a traction rod assembly for a bogie system includes a body extending between a first end and a second end, and a bush assembly operably coupled with the first end of the body. The bush assembly includes a first component having a passage extending between a first surface and a second surface of the first component, and a second component disposed within the passage of the first component. The bush assembly includes an eccentric offset such that a center of the first component is offset from a center of the second component.

In one or more embodiments, a traction rod assembly for a bogie system includes a body extending between a first end and a second end. A bush assembly is operably coupled with the first end of the body. The bush assembly includes a first component having a passage extending between a first surface and a second surface of the first component, and a second component disposed within the passage of the first component. The bush assembly includes an eccentric offset such that a center of the first component is offset from a center of the second component. A bearing assembly is operably coupled with the second end of the body. The bearing assembly includes cylindrical bearings and one or more spacers disposed along a bearing axis. The cylindrical bearings and the one or more spacers are concentric with a passage disposed at the second end of the body along the bearing axis. The bush assembly is operably coupled with a frame of the bogie system and the bearing assembly is operably coupled with an axle assembly of the bogie system. The bearing assembly allows rotation of the body relative to the axle assembly of the bogie system.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
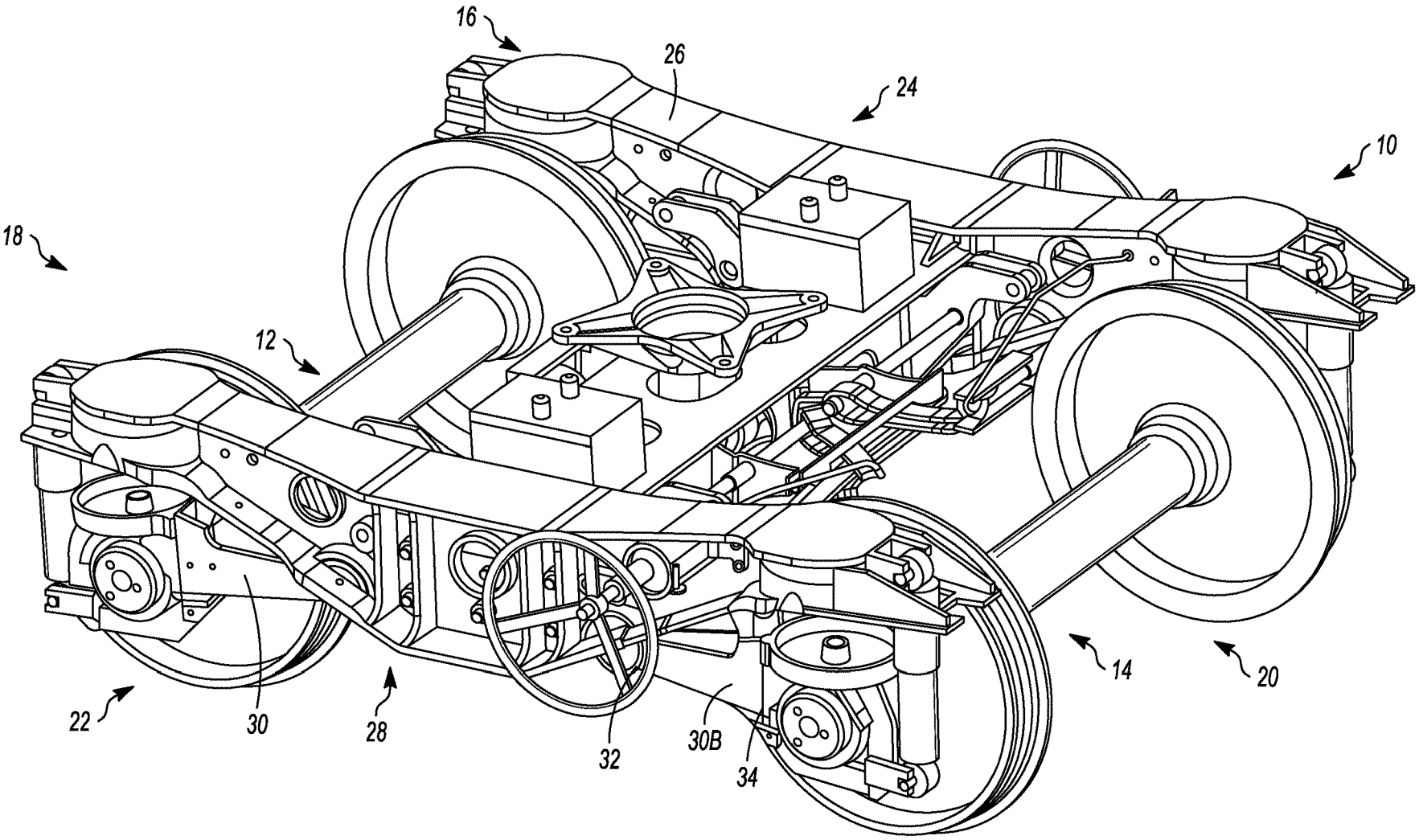
FIG. 1 illustrates a perspective view of a bogie assembly comprising a radial arm.

Embodiments of the subject matter described herein relate to traction rod assemblies and methods that may be used with bogie and/or vehicle systems. The traction rod assemblies may include a body that extends between a first end and a second end. The first end may be operably coupled with a frame of the bogie, and the second end may be operably coupled with an axle assembly of the bogie. In one embodiment, the second end may be operably coupled with an axle box of the axle assembly. Optionally, the first end of the traction rod assembly may be coupled with a component of the bogie other than the frame, and/or the second end of the traction rod assembly may be coupled with a component other than the axle box of the axle assembly.

In one or more embodiments, a bush assembly may be coupled with and/or disposed at the first end of the body. The bush assembly may also be referred to herein as a metal elastic bush or metal elastic bush assembly. For example, the bush assembly may include one or more metallic components and one or more elastomeric components coupled with the one or more metallic components. The elastomeric component of the bush assembly may move in one or more directions responsive to the first end of the traction rod assembly being coupled with the bogie system. For example, a length of the traction rod assembly may move and/or be adjusted based on movement of the elastomeric component and an eccentric offset of the bush assembly.

In one or more embodiments, a bearing assembly may be coupled with and/or disposed at the second end of the body. The bearing assembly may include cylindrical bearings that may receive a feature or portion of the axle assembly of the bogie system. As one example, the cylindrical bearings may receive a feature of the axle box of the axle assembly. The cylindrical bearings may allow rotation of the body of the traction rod assembly relative to the axle assembly of the bogie system. An outer race of each of the cylindrical bearings are allowed to rotate while an inner race of each of the cylindrical bearings remains fixed with the axle box. For example, the outer race of the cylindrical bearings may allow the body of the traction rod assembly to rotate responsive to a load being applied to the frame of the bogie (e.g., cargo being loaded onto the bogie) or a load being removed from the frame (e.g., a cargo being unloaded from the bogie), while the stationary inner race of the bearings coupled with the portion of the axle box may reduce an amount of rotation of the axle box.

The traction rod assembly reduces an amount of longitudinal movement of the axle box of the axle assembly and/or of the frame (e.g., forward or backward movement of the axle box, such as in a direction of movement of the bogie) relative to a bogie that does not include a traction rod assembly coupled with the axle box and the frame. The traction rod assembly reduces an amount of lateral movement of the axle box and/or the frame (e.g., side to side movement of the axle box in a direction that is substantially perpendicular to the direction of movement of the bogie) relative to a bogie that does not include a traction rod assembly coupled with the axle box and the frame. The traction rod assembly reduces an amount of vertical movement of the axle box and/or the frame (e.g., up and down movement of the axle box in a direction that is substantially perpendicular to the direction of movement of the bogie) relative to a bogie that does not include a traction rod assembly coupled with the axle box and the frame In one or more embodiments, the bogie system may include plural traction rod assemblies. For example, the bogie system may include a number of traction rod assemblies and a same number of wheels that are operably coupled with the bogie system. Alternatively, the bogie system may include a number of traction rod assemblies and a same number of axles of the bogie system. Optionally, the bogie system may include any number of traction rod assemblies.

In one or more embodiments, one or more of the traction rod assemblies may include a bearing assembly but may not include a bush assembly. Additionally or alternatively, one or more of the traction rod assemblies may include a bush assembly but may not include a bearing assembly. For example, a bogie system may include one traction rod assembly that includes a bearing assembly but does not include a bush assembly, and another traction rod assembly that includes a bush assembly but does not include a bearing assembly. Optionally, the bogie system may include one or more traction rod assemblies each having the same and/or different configurations relative to each other.

One or more embodiments of the inventive subject matter may relate to bogies systems that may be used with rail vehicle systems, or other types or models of vehicle systems, such as automobiles, trucks, buses, mining vehicles, agricultural vehicles, other off-highway vehicles, or any other moving system that includes a suspension system.

Figure 2:
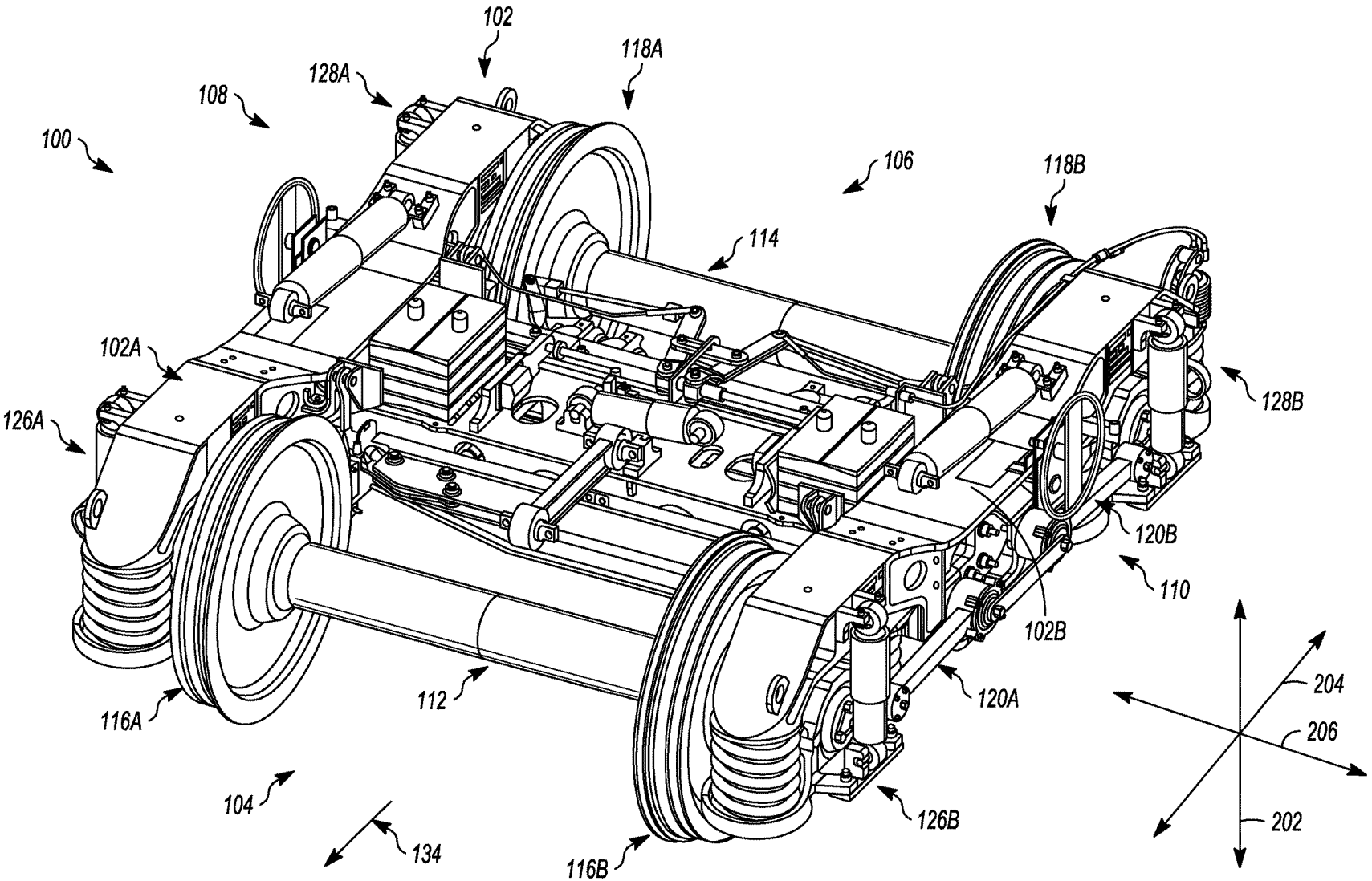
FIG. 2 illustrates a perspective view of a bogie system in accordance with one embodiment.
Figure 3:
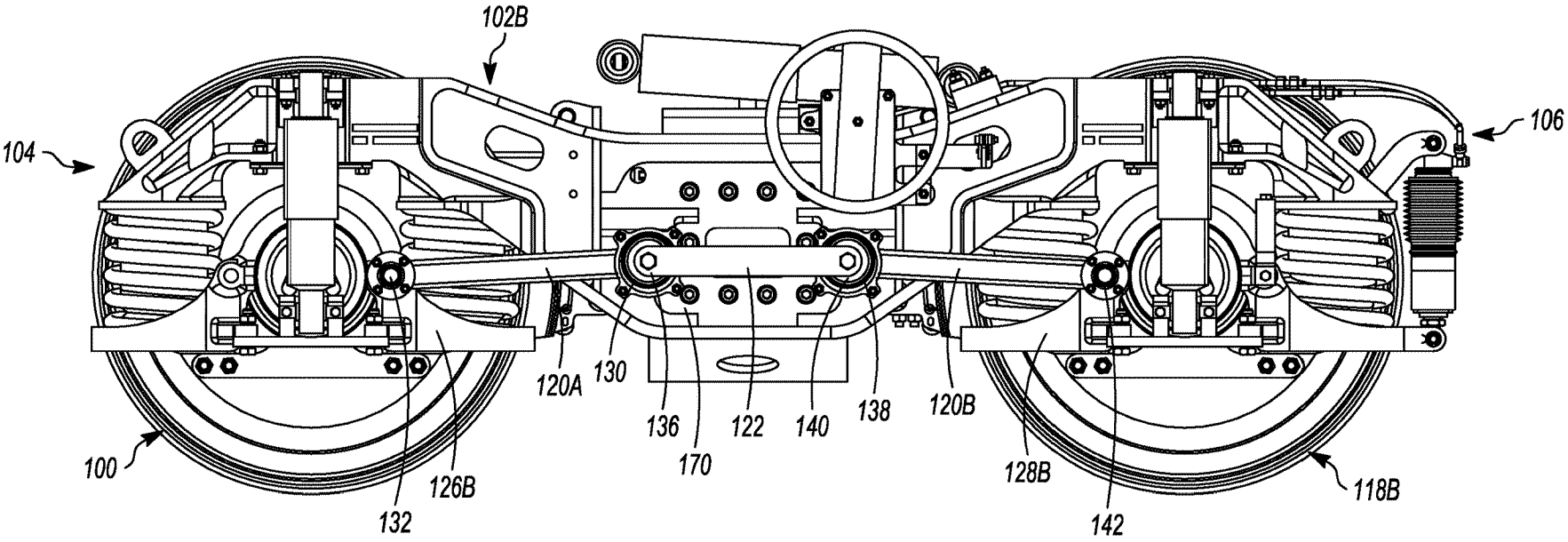
FIG. 3 illustrates a side view of the bogie system shown in FIG. 2.

FIG. 2 illustrates a perspective view of a bogie system 100 in accordance with one embodiment. FIG. 3 illustrates a side view of the bogie system shown in FIG. 2. The bogie system extends between a front end 104 and a rear end 106 (e.g., in a direction of movement 134 of the bogie system along a route), and a first side 108 and a second side 110. A first axle 112 (e.g., a front axle) is disposed proximate the front end of the bogie system and is operably coupled with first and second wheels 116A, 116B that are disposed proximate the first and second sides of the bogie system, respectively. A second axle 114 (e.g., a rear axle) is disposed proximate the rear end of the bogie system and is operably coupled with first and second wheels 118A, 118B that are disposed proximate the first and second sides of the bogie system, respectively.

The first axle is operably coupled with an axle box 126A of the axle assembly proximate the first side of the bogie system and is operably coupled with an axle box 126B of the axle assembly proximate the second side of the bogie system. Additionally, the second axle is operably coupled with an axle box 128A proximate the first side of the bogie system and is operably coupled with an axle box 128B proximate the second side of the bogie system.

The bogie system includes a frame 102 that includes plural surfaces that extend in one or more different directions. For example, the frame separates and/or provides a level of protection to a suspension system of the bogie system from what may be disposed on top of the frame (e.g., cargo, a vehicle frame, or the like). A first side 102A of the frame extends between about the front end and about the rear end of the bogie system and extends over a top side of the axle boxes 126A, 128A. A second side 102B of the frame extends between about the front end and about the rear end of the bogie system, and extends over a top side of the axle boxes 126B, 128B. A portion 170 of the frame (shown in FIG. 3) extends away from the second side 102B of the frame in a direction that is substantially perpendicular to a direction of extension of the second side of the frame. For example, the portion of the frame is substantially planar with the wheels 116B, 118B.

The bogie system includes one or more traction rod assemblies 120. In the illustrated embodiment of FIGS. 2 and 3, a first traction rod assembly 120A includes a first end 130 that is operably coupled with the portion 170 of the frame, and a second end 132 that is operably coupled with the axle box 126B. A second traction rod assembly 120B includes a first end 140 that is operably coupled with the portion 170 of the frame, and a second end 142 that is operably coupled with the axle box 128B. The first and second traction rod assemblies are disposed on the second side of the bogie system. Optionally, the bogie system may include two traction rod assemblies disposed on the first side of the bogie system (not shown) such that the bogie system includes four traction rod assemblies. Optionally, the bogie system may include any number of traction rod assemblies. In one embodiment, a bogie system may include one or more traction rod assemblies disposed on a first side of the bogie system, and may be devoid any traction rod assemblies or may include two or more traction rod assemblies on a second side. Optionally, the bogie system may include a traction rod assembly disposed on the first side 108 of the bogie system at a forward position (e.g., in the direction of movement of the bogie system) and include a traction rod assembly disposed on the second side 110 of the bogie system at a rearward position. Optionally, the bogie system may have an alternative configuration of one or more traction rod assemblies.

The first and second ends of the traction rod assemblies are fixed to the frame and the corresponding axle box, respectively, such that the traction rod assemblies reduce an amount of movement of the axle boxes relative to a bogie system that does not include a traction rod assembly. Optionally, the traction rod assemblies may be fixed to another feature or component of the axle assembly of the bogie system. The traction rod assemblies reduce an amount of movement of the axle boxes in a vertical direction 202 (e.g., up and down), reduce an amount of movement of the axle boxes in a longitudinal direction 204 (e.g., forward and backward), and reduce an amount of movement of the axle boxes in a lateral direction 206 (e.g., side and side), relative to a bogie system that does not include a traction rod assembly. For example, the traction rod assemblies increase an amount of rigidity of the bogie system relative to a bogie system that does not include a traction rod assembly.

In one or more embodiments, the bogie system may include a connecting link 122. In the illustrated embodiment of FIG. 3, the connecting link extends between a first end 136 that is operably coupled with the portion 170 of the frame and the first end 130 of the first traction rod assembly 120A, and a second end 138 that is operably coupled with the portion of the frame and the first end 140 of the second traction rod assembly 120B. In one or more embodiments, the connecting link 122 may control an amount of longitudinal forces (e.g., in the longitudinal direction 204) that may be directed onto the first and/or second traction rod assemblies. For example, during a braking action by the bogie system, braking forces may be directed onto the first and second traction rod assemblies in a direction that is substantially opposite the direction of movement 134 of the bogie system. The connecting link may control an amount of the braking forces that may be directed to the second traction rod assembly.

The second side linkage system including the first and second traction rod assemblies and the connecting link disposed on the second side of the bogie system is positioned outside of the frame of the bogie system. For example, the wheels 116B and 118B disposed on the second side of the bogie system are positioned between the second side linkage system and the wheels 116A, 118A disposed on the first side of the bogie system in the lateral direction 206.

In one or more embodiments, the first side of the bogie system (not shown in FIGS. 2 and 3) that is opposite the second side may include one or more traction rod assemblies and/or one or more connecting links to form a first side linkage system on the first side of the bogie system at a position outside of the frame of the bogie system. For example, the wheels 116A and 118A disposed on the first side of the bogie system are positioned between the first side linkage system and the wheels 116B, 118B disposed on the second side of the bogie system in the lateral direction 206. Alternatively, the first side linkage system may have an alternative configuration and/or orientation relative to the configuration and/or orientation of the second side linkage system disposed on the second side of the bogie system.

Figure 4:
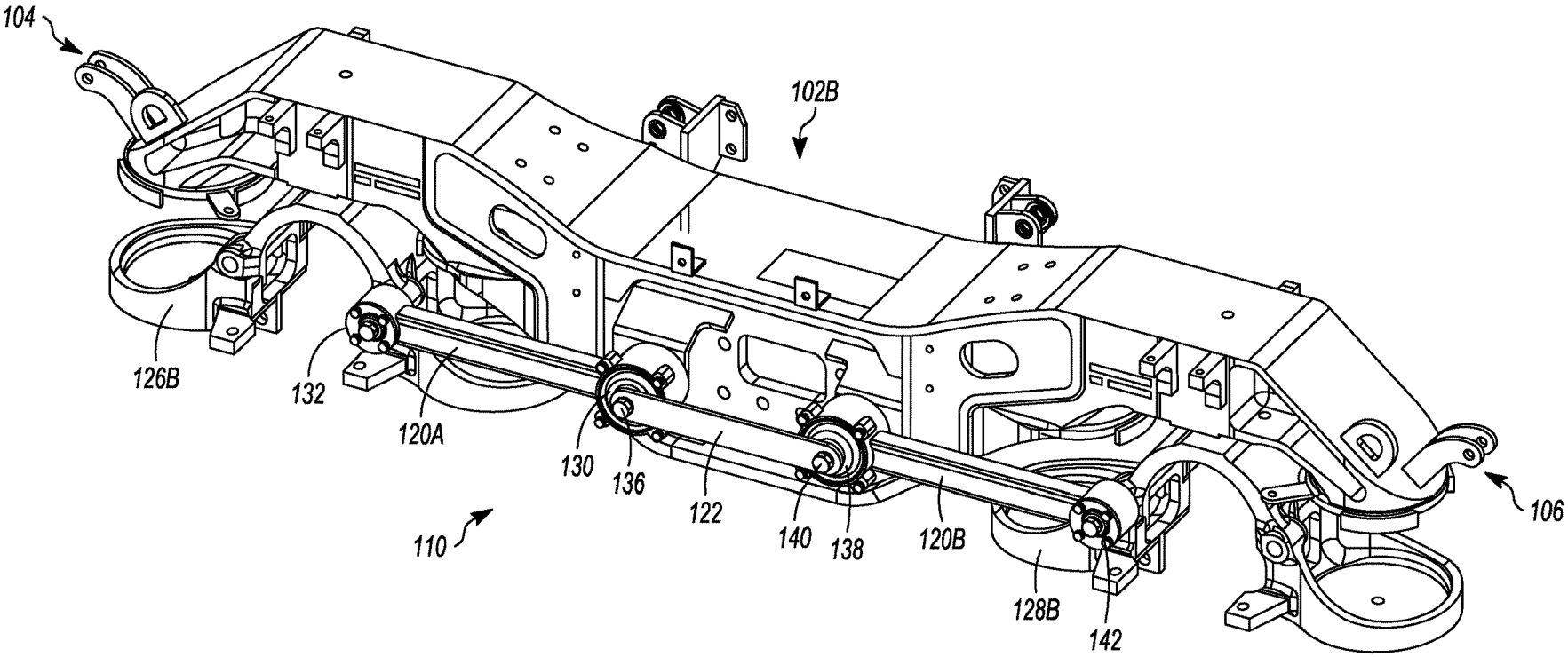
FIG. 4 illustrates a perspective view of a bogie system in accordance with one embodiment.

FIG. 4 illustrates a perspective view of two of the traction rod assemblies 120A, 120B coupled with a bogie system. In the illustrated embodiment of FIG. 4, several components of the bogie system are hidden from view for clarity. The first end 130 of the traction rod assembly 120A is operably coupled with a portion of the frame 102B and the first end 136 of the connecting link 122, and the second end 132 of the traction rod assembly 120A is operably coupled with a portion of the axle box 126B. The first end 140 of the traction rod assembly 120B is operably coupled with a portion of the frame 102B and the second end 138 of the connecting link 122, and the second end 142 of the traction rod assembly 120B is operably coupled with a portion of the axle box 128B. For example, the two traction rod assemblies and the connecting link form the second side linkage system between the axle boxes and the frame of the bogie system. The second side linkage system is disposed outside of the frame of the bogie system. For example, the traction rod assemblies are coupled with components of the bogie system at exterior locations of the bogie system, and are not coupled with the bogie system at positions between the first and second sides 108, 110 of the bogie system (e.g., shown in FIG. 2).

Figure 5:
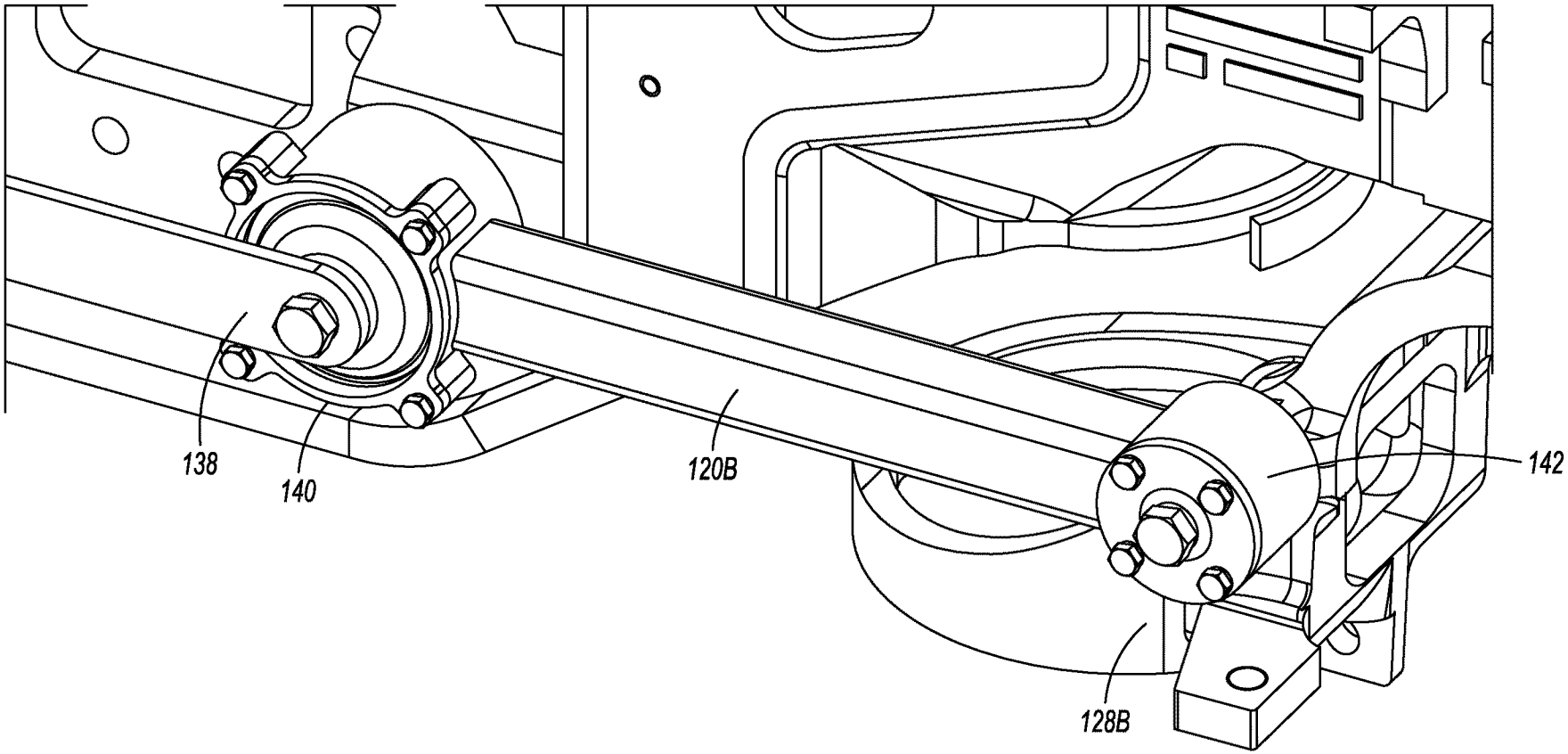
FIG. 5 illustrates a magnified view of the bogie system shown in FIG. 4.

FIG. 5 illustrates a magnified view of the bogie system shown in FIG. 4. The first end 140 of the traction rod assembly, including a bush assembly, is coupled with a portion of the frame of the bogie system, and the second end 142 of the traction rod assembly, including a bearing assembly, is coupled with a portion of the axle box 128B.

Figure 6:
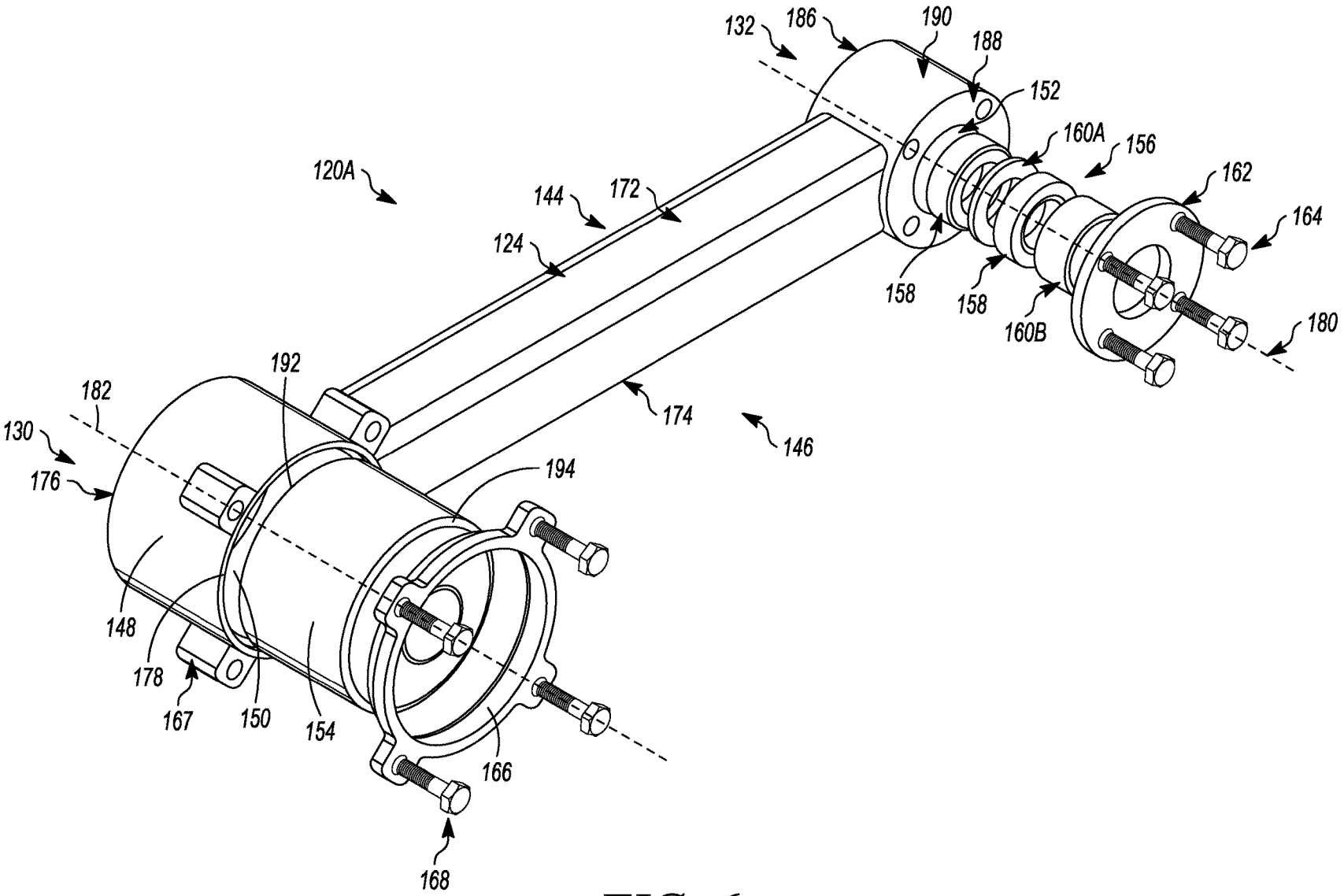
FIG. 6 illustrates an exploded view of a traction rod assembly in accordance with one embodiment.

FIG. 6 illustrates an exploded view of the traction rod assembly 120 in accordance with one embodiment. The traction rod assembly includes a body 124 that extends between the first end 130 and the second end 132. The body has a first side 144 and an opposite second side 146, a top side 172 and an opposite bottom side 174. In the illustrated embodiment, the body of the traction rod assembly has a substantially rectangular cross-sectional shape that extends between the first and second ends. Optionally, the body of the traction rod assembly may have any alternative shape.

The first end 130 of the body has a first end body 148 that has a substantially circular cross-sectional shape about an axis 182 and is elongated along the axis between first and second surfaces 176, 178. The first end body includes an opening or passage 150 that extends along the axis between the first and second surfaces. The second end 132 of the body has a second end body 190 that has a substantially circular cross-sectional shape about a bearing axis 180 and is elongated along the bearing axis between first and second surfaces 186, 188. The second end body includes an opening or passage 152 that extends along the bearing axis between the first and second surfaces. In the illustrated embodiment of FIG. 6, the first end body has a size that is greater than a size of the second end body. Optionally, the second end body may have a size substantially equal to or greater than the size of the first end body. Optionally, the first end body may have an alternative shape that may be a unique or common shape and/or size relative to the shape and/or size of the second end body.

The passage 150 of the first end body receives a bush assembly 154. The bush assembly extends between a first end 192 and a second end 194. The first end may be substantially flush with the first surface 176 of the first end body, and the second end may be substantially flush with the second surface 178 of the first end body when the bush assembly is positioned within the passage 150. Alternatively, one or both of the first end or second ends of the bush assembly may not be substantially flush with the first or second surfaces, respectively.

Figure 7:
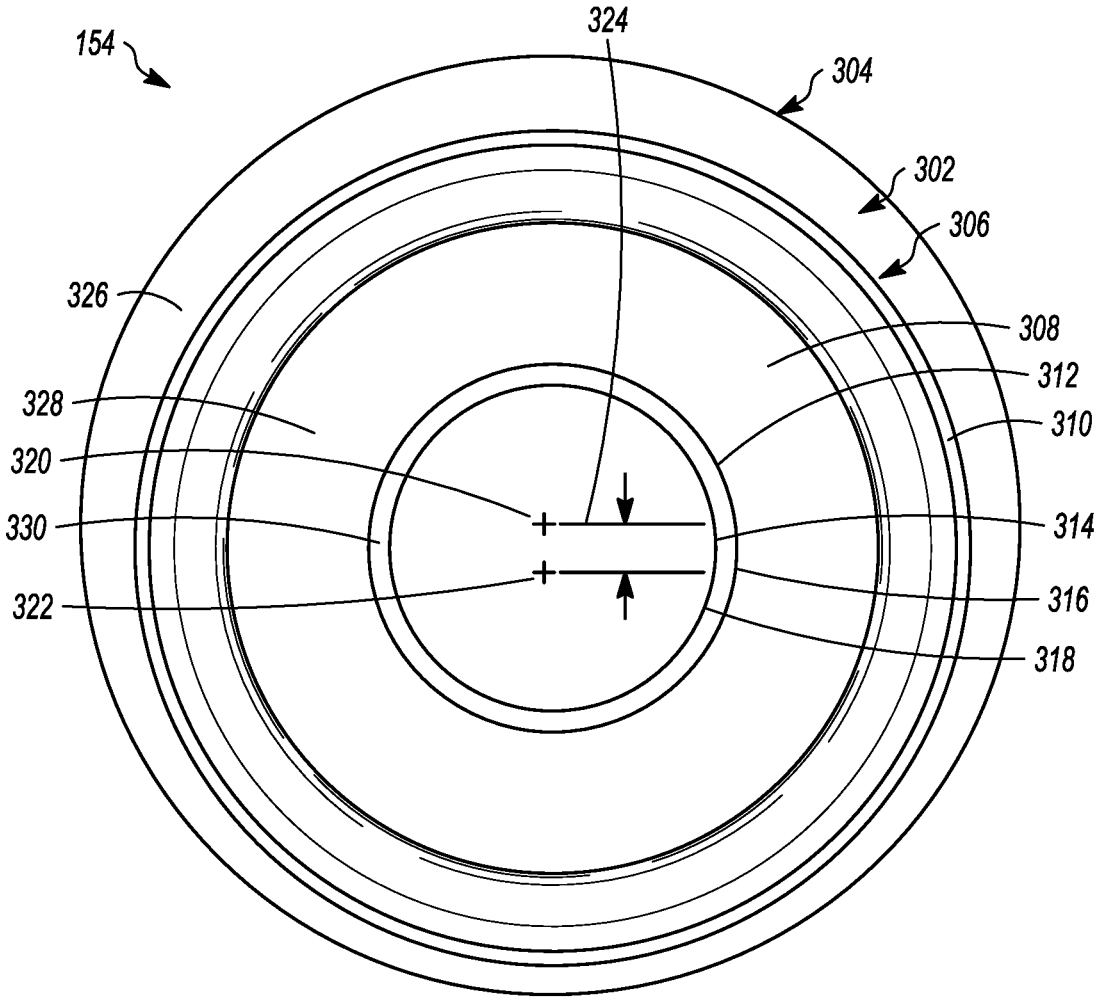
FIG. 7 illustrates a front view of a bush assembly in accordance with one embodiment.

FIG. 7 illustrates a front view of the bush assembly in accordance with one embodiment. The bush assembly includes a first component 302 that has an exterior surface 304 and an interior surface 306. The interior surface of the first component is operably coupled with an exterior surface 310 of a second component 308. For example, the exterior surface of the second component may be bonded to, adhered to, fastened to, or the like, the interior surface of the first component. An interior surface 312 of the second component is operably coupled with an exterior surface 316 of a third component 314. For example, the exterior surface of the third component may be bonded to, adhered to, fastened to, or the like, the interior surface of the second component. The first, second, and third components are operably coupled together to form the bush assembly that may be disposed or positioned within the opening or passage of the first end of the body of the traction rod assembly.

In one or more embodiments, the bush assembly may be referred to as a metal elastic bush assembly, a metal bush assembly, a metal elastic bush, or the like. For example, the first component may be manufactured of a metal alloy, a metallic engineered material, a composite material, or the like. In one or more embodiments, the first component may be manufactured out of the same or a common material as the body of the traction rod assembly. The first component may also be referred to as a metal component, metal piece, metal structure, or the like. Optionally, the first component may be manufactured of an alternative material. The third component may be manufactured of a metal or metallic alloy, that may have a chemical composition that is the same or different than a chemical composition of the material of the first component. The third component may also be referred to as a mating component, mating structure of the bush assembly, or the like. For example, the mating or third component is configured to be operably coupled with a portion of the frame of the bogie system.

The second component may be manufactured of an elastomer, that is, of an elastomeric material. Examples of elastomeric materials may include natural and/or synthetic rubber. Optionally, the second component may be manufactured of a polymer material such as, but not limited to, a low and/or high density polyethylene, polypropylene, polyvinyl chloride (PCV), nylon, Teflon, a thermoplastic polyurethane material, or the like. In one or more embodiments, the design, configuration, orientation, shape, size, or the like, of the second component may be adjusted to tune the longitudinal and/or lateral characteristics of the suspension of the bush assembly based on the material used to form the second component. In one embodiment, the elastic material may be a conductive elastic material, or alternatively may be a non-conductive material. The second component may be referred to herein as an elastomer component, a rubber component, a flexible structure, or the like. In one embodiment, the material composition of the first component and the material composition of the third component have stiffnesses may be greater than a stiffness of the material composition of the second component. For example, the second component is configured to flex or move, and the first and third components are configured to remain substantially stationary, fixed, or unmoved.

The first component extends between a first surface (not visible in FIG. 7) and a substantially opposite second surface 326 along a first center axis 320. The second component extends between a first surface (not visible in FIG. 7) and a substantially opposite second surface 328 along a second center axis 322. The third component extends between a first surface (not visible in FIG. 7) and a substantially opposite second surface 330 along the second center axis 322. For example, the second component is concentric with the third component, and the first component is not concentric with the second and third components about the second center axis.

In one or more embodiments, the first surfaces of two or more of the first, second, or third components may be substantially planar with each other. Additionally or alternatively, the second surfaces of two or more of the first, second, or third components may be substantially planar with each other. In one or more embodiments, the first and/or second surfaces of one or more of the first, second, or third components may include one or more radii, curves, chamfers, or the like. For example, in the illustrated embodiment of FIG. 7, a portion of the second surface of the elastomeric or second component is concave and another portion of the second surface is convex such that the second surface is contoured in different directions between the exterior surface and the interior surface of the second component. Alternatively, the second surfaces of one or more of the first, second, or third component may have an alternative shape.

The bush assembly includes an eccentric offset 324 such that the first center axis 320 of the first component is offset from the second center axis 322 of the second and third components. In one or more embodiments, the eccentric offset may be a distance that is about 1 millimeter (mm), about 3 mm, about 5 mm, about 10 mm, or the like. The eccentric offset enables the elastomeric or second component of the bush assembly to move in one or more directions responsive to the first end of the traction rod assembly being coupled with the bogie system. For example, a length of the traction rod assembly may move and/or be adjusted based on movement of the second component and the eccentric offset of the bush assembly. The eccentric offset allows the traction rod assembly to be more accurately positioned when the traction rod assembly is coupled with the bogie system relative to a bush assembly not including an eccentric offset. Additionally, the eccentric offset increases a design tolerance (e.g., makes less restrictive) of the traction rod assembly relative to a traction rod assembly not including a bush assembly having an eccentric offset.

Returning to FIG. 6, the bush assembly may be coupled with or contained within the passage of the first end of the body by bonding, adhering, fastening, or the like, the exterior surface of the first component with an interior surface of the passage of the first end of the body. Optionally, the position of the bush assembly may be maintained within the passage via one or more assembly components. FIG. 6 illustrates one example of an assembly system used to couple the bush assembly with the first end of the body. In the illustrated embodiment, an assembly component 166 (e.g., a washer) is coupled with the first end of the body via one or more assembly fasteners 168 (e.g., screws) received within corresponding fastener passages 167 (e.g., screw holes) coupled with the first end body of the traction rod assembly.

The assembly system shown in FIG. 6 may hold or maintain a position of the bush assembly within the passage of the first end of the body. For example, the assembly component and fastener assemblies may increase an amount of pressure directed onto the bush assembly when the bush assembly is disposed within the passage to maintain a position of the bush assembly within the passage. Optionally, the assembly components may be any alternative fastening components that may maintain a position of the bush assembly within the first end of the body. As one example, the assembly component may be a clamp or hinged component that may extend around the exterior of the first end of the body, and may be fixed, coupled, or held onto the first end of the body via one or more locking mechanisms.

Figure 8:
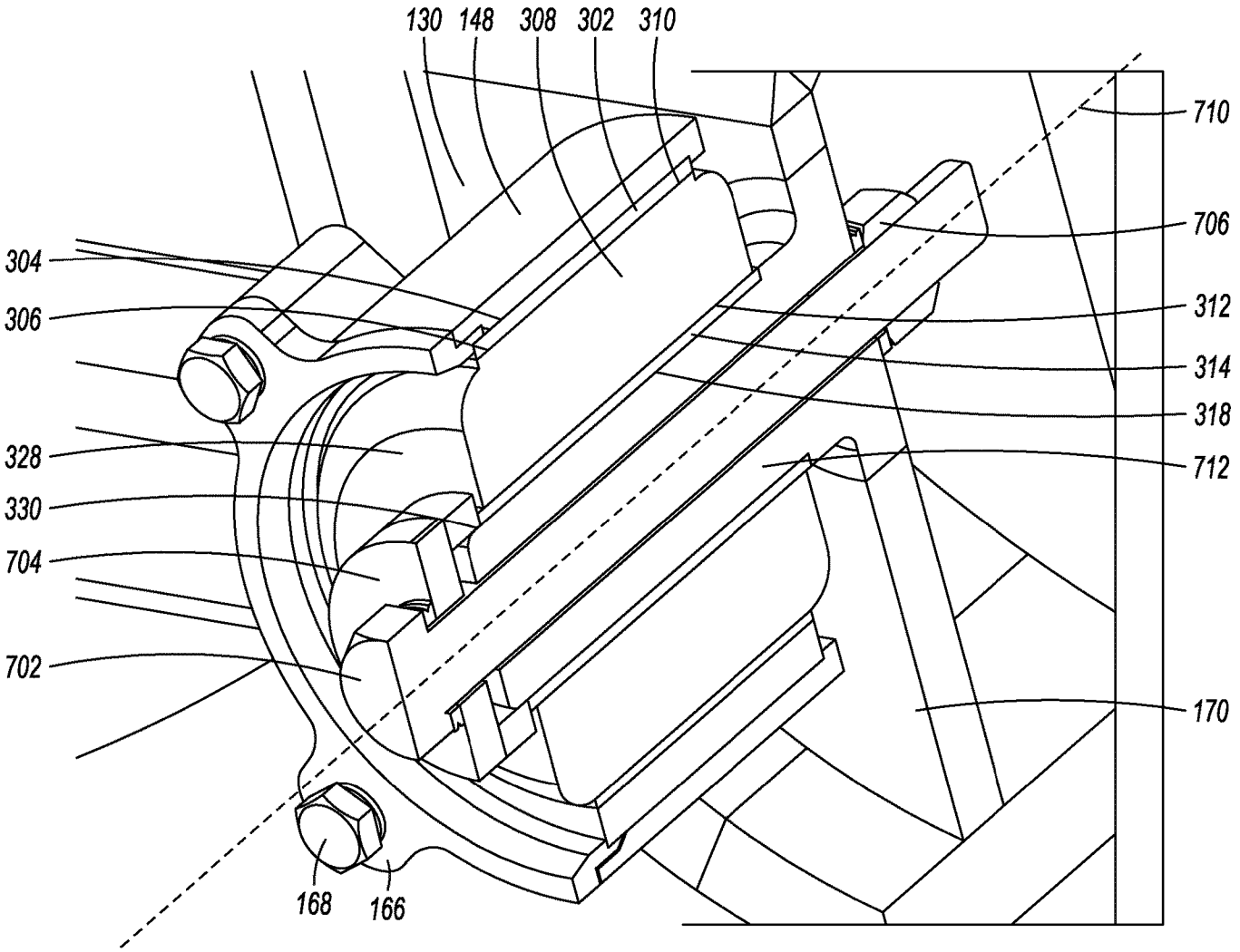
FIG. 8 illustrates a cross-sectional view of the bush assembly shown in FIG. 7 coupled with a bogie system in accordance with one embodiment.

FIG. 8 illustrates a cross-sectional view of the first end of the traction rod assembly coupled with the portion 170 of the frame of the bogie system. The portion of the frame incudes a frame mating post 712 that extends a distance away from the frame. A passage defined by an interior surface 318 or mating surface of the third component 314 of the bush assembly is configured to receive the frame mating post along a mating axis 710. The position of the first end of the traction rod assembly assembled to the frame is controlled by one or more coupling components. In the illustrated embodiment of FIG. 8, a bolt 702 extends through a washer 704 and through a passage of the frame mating post, and is coupled with the frame via a nut 706 at an interior position of the portion 170 of the frame. In alternative embodiments, the first end of the traction rod assembly may be coupled with the frame via an alternative fastening or coupling configuration and/or coupling components.

As the bogie system operates with the first end of the traction rod assembly coupled with the frame, the second component (e.g., the elastomeric component) of the bush assembly flexes or moves relative to the first component (e.g., the metallic component). For example, a stiffness of the elastomeric material that is used to manufacture the second component controls an amount of movement of the first end of the traction rod assembly relative the frame. In one or more embodiments, the stiffness of the second component may control a rigidity of the bogie system, such as when the bogie system is moving along a route, when cargo is loaded and/or unloaded onto the bogie system, when the bogie system changes a propulsion and/or braking operation, or the like. For example, the material properties, including the stiffness of the elastomeric material of the second component, may control a smoothness of the bogie system as the bogie system moves along the route. For example, the second component may flex and/or move to dampen one or more movements of the frame relative to the axle box of the bogie system.

Returning to FIG. 6, the second end 132 of the body may include a bearing assembly 156 that is disposed within the opening or passage 152 of the second end of the body of the traction rod assembly. In the illustrated embodiment of FIG. 6, the bearing assembly includes two cylindrical bearings 158 and two spacers 160A, 160B. A first spacer 160A is disposed between the two cylindrical bearings 158 and a second spacer 160B is disposed outside of the two cylindrical bearings. Optionally, the number of spacers, the position of each of the different spacers relative to each of the bearings, and/or the size and/or shape of the different spacers may vary. In the illustrated embodiment, the cylindrical bearings and the spacers extend along the bearing axis 180, and are substantially concentric with each other and with the passage of the second end of the body.

The bearing assembly including the cylindrical bearings and the spacers may be assembled within the passage of the second end of the body by inserting the bearing assembly into the passage from the second surface 188 of the second end and moving the bearing assembly in a direction toward the first surface 186 of the second end along the bearing axis. The bearing assembly may be maintained within the passage via one or more assembly components 162 and/or one or more assembly fasteners 164. For example, in the illustrated embodiment of FIG. 6, the assembly component is a washer that includes a number of mounting openings (e.g., screw or bolt holes), and the second surface of the second end of the body includes a same number of mounting openings as the assembly component. The assembly component is coupled with the second surface of the second end of the body via the assembly fasteners extending through the mounting openings of the assembly component and fastening to the second end of the body. Alternatively, the position of the bearing assembly may be maintained within the passage of the second end of the body via an alternative coupling or fastening mechanism or assembly.

The illustrated embodiment of the traction rod assembly shown in FIG. 6 includes a bush assembly and a bearing assembly coupled with the body of the traction rod assembly. Alternatively, in one or more embodiments, the first end of the body of the traction rod assembly may include a bush assembly, but the second end of the body may be devoid a bearing assembly. For example, the traction rod assembly may include the bush assembly that may be operably coupled with a portion of the frame of the bogie system, and the second end of the body (e.g., devoid a bearing assembly) may be coupled with another portion and/or component of the bogie system. Alternatively, the second end of the body of the traction rod assembly may include a bearing assembly, but the first end of the body may be devoid a bush assembly. For example, the bearing assembly disposed at the second of the body may be operably coupled with a component of an axle box of the bogie system, and the first end of the body (e.g., devoid a bush assembly) may be coupled with another portion and/or component of the bogie system, such as a portion of the frame of the bogie system.

Figure 9:
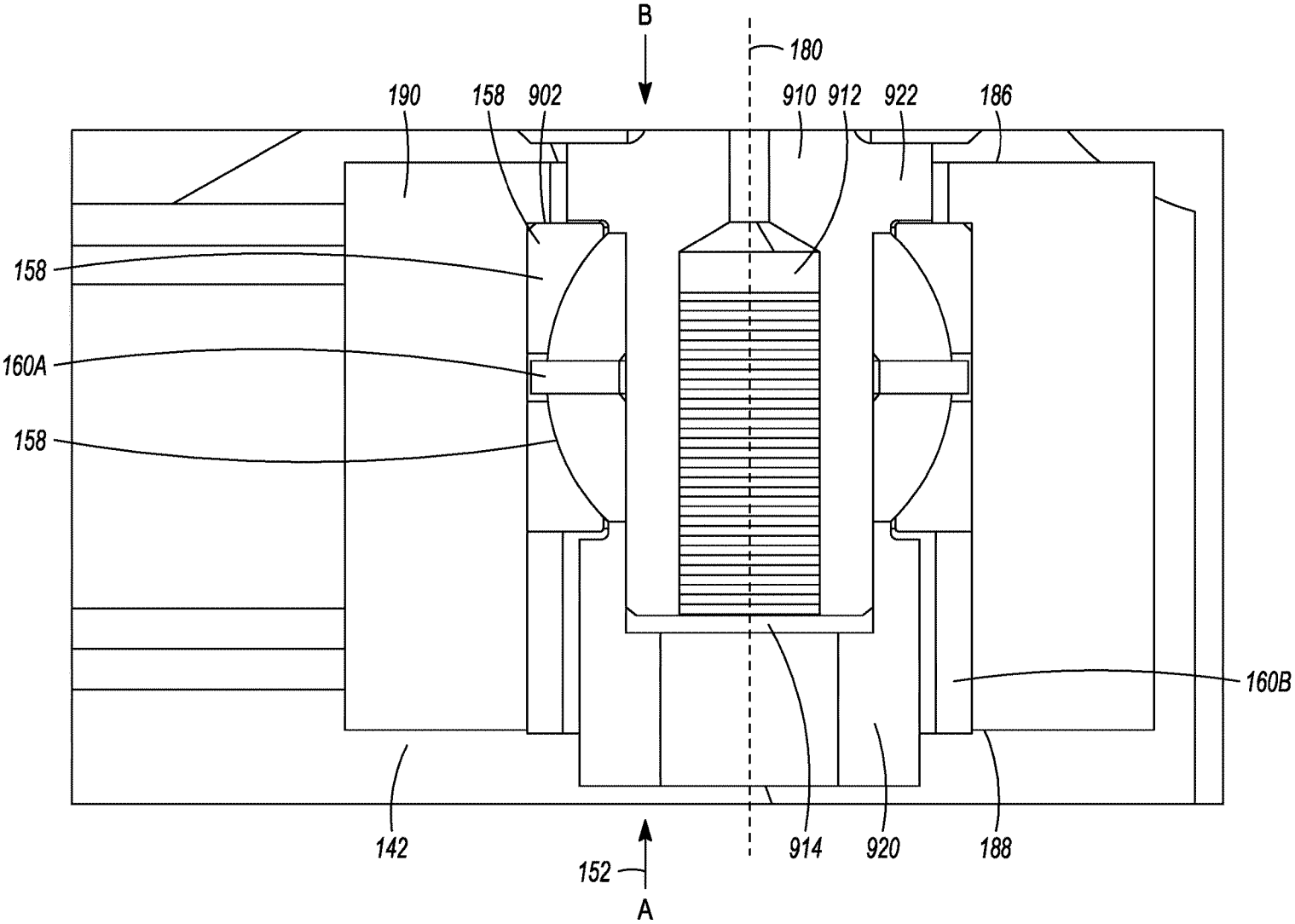
FIG. 9 illustrates a cross-sectional view of a second end of a traction rod assembly in accordance with one embodiment.
Figure 10:
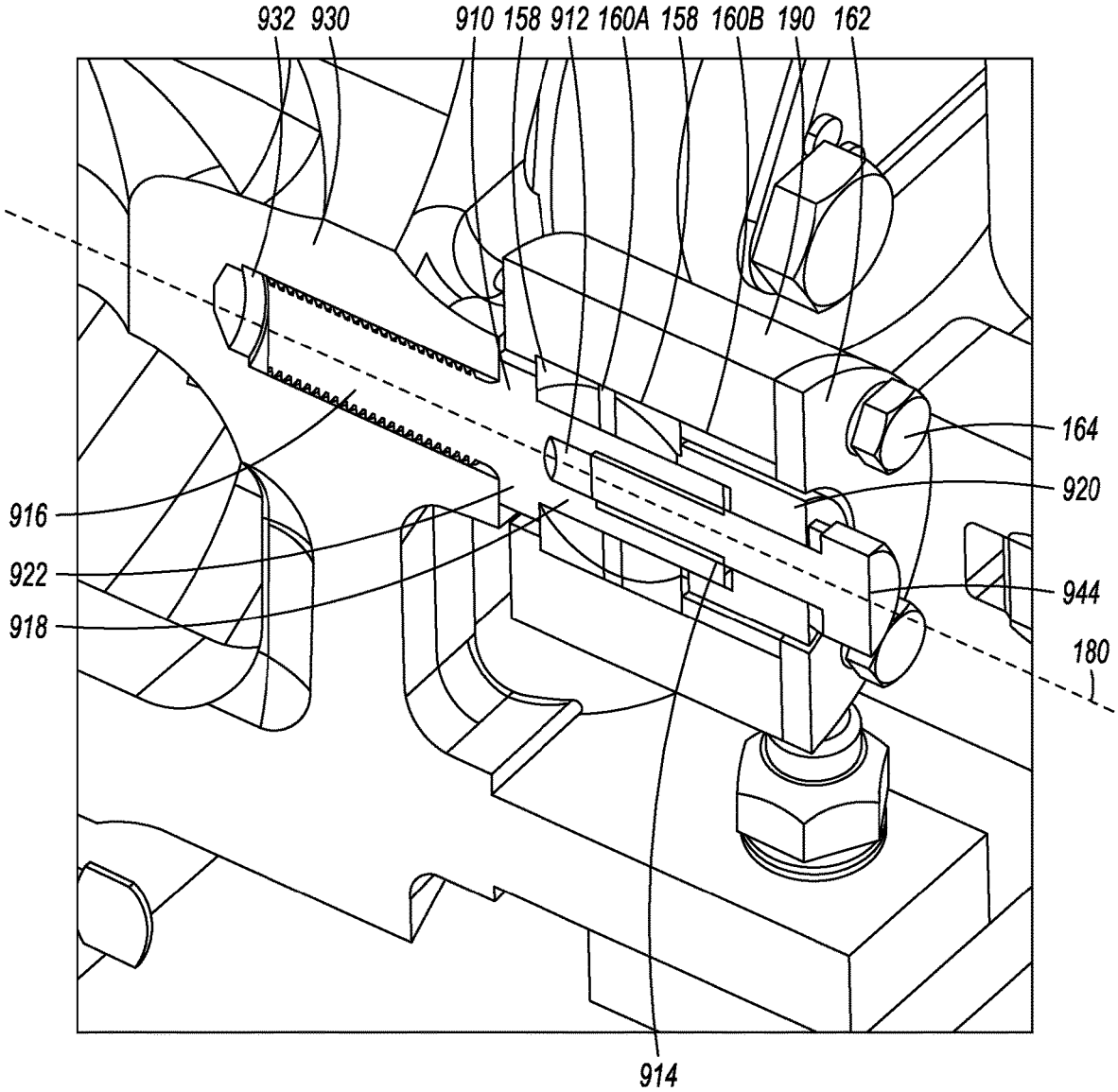
FIG. 10 illustrates a cross-sectional view of the second end of the traction rod assembly shown in FIG. 9 coupled with a bogie system in accordance with one embodiment.

FIG. 9 illustrates a cross-sectional view of the second end of the traction rod assembly 120B coupled with the bogie system in accordance with one embodiment. FIG. 10 illustrates a cross-sectional view of the second end of the traction rod assembly coupled with an axle box of the bogie system in accordance with one embodiment. The bearing assembly including the cylindrical bearing 158, the first spacer 160A, and the second spacer 160B are disposed within the passage of the second end of the body. The bearing assembly is directed into the passage of the body in a first direction A. The passage includes a lip 902 that is disposed proximate the first surface 186 of the second end of the body and extends into the passage. The lip prohibits additional travel of the bearing assembly in the first direction A after the bearing assembly is operably coupled with the lip. The assembly component 162 (e.g., a washer) and the assembly fasteners 164 are coupled with the second surface of the body to maintain a position of the bearing assembly within the traction rod assembly and prohibit movement of the bearing assembly in a second direction B.

In the illustrated embodiment, a first assembly component 910, a second assembly component 920, and a bolt 944 are used to couple the second end of the traction rod assembly with the axle box. The first assembly component includes a first end 916 that is received within an axle box body pocket 932 of an axle box body 930. In the illustrated embodiment, the first end and the axle box body pocket have corresponding threads to couple the first assembly component with the axle box body. The first assembly component also includes a second end 918 that is received within a passage of the bearing assembly. The first assembly component includes a lip 922 that separates the first end from the second end, controls an amount of movement of the first assembly component in the first direction A, and controls an amount of movement of the second end of the traction rod assembly in the first direction A.

The second assembly component 920 is directed into the passage of the bearing assembly in the first direction A, and is configured to mate with the second spacer 160B within the passage. In the illustrated embodiment, the second assembly component extends a distance beyond the second surface 188 of the second end of the body. Alternatively, the second assembly component may have an alternative shape and/or size, may be substantially flush with the second surface, or any combination therein. In the illustrated embodiment, a portion of the second end of the first assembly component extends within a passage of the second assembly component. The second assembly component and the second end of the first assembly component receive the bolt 944 that couples the second end of the traction rod assembly with the axle box of the bogie system. Optionally, the second end of the traction rod assembly may be operably coupled with the axle box of the bogie system via an alternative assembly method and one or more alternative assembly components.

The cylindrical bearings may allow rotation of the body of the traction rod assembly relative to the axle box of the bogie system. For example, an outer race of each of the cylindrical bearings is allowed to rotate while an inner race of each of the cylindrical bearings remains fixed. For example, the outer race of the cylindrical bearings may allow the body of the traction rod assembly to rotate responsive to a load being applied to the frame of the bogie (e.g., cargo being loaded onto the bogie) or a load being removed from the frame (e.g., a cargo being unloaded from the bogie), while the stationary inner race of the cylindrical bearings coupled with the portion of the axle box via the assembly components may reduce an amount of rotation of the axle box.

Figure 11:
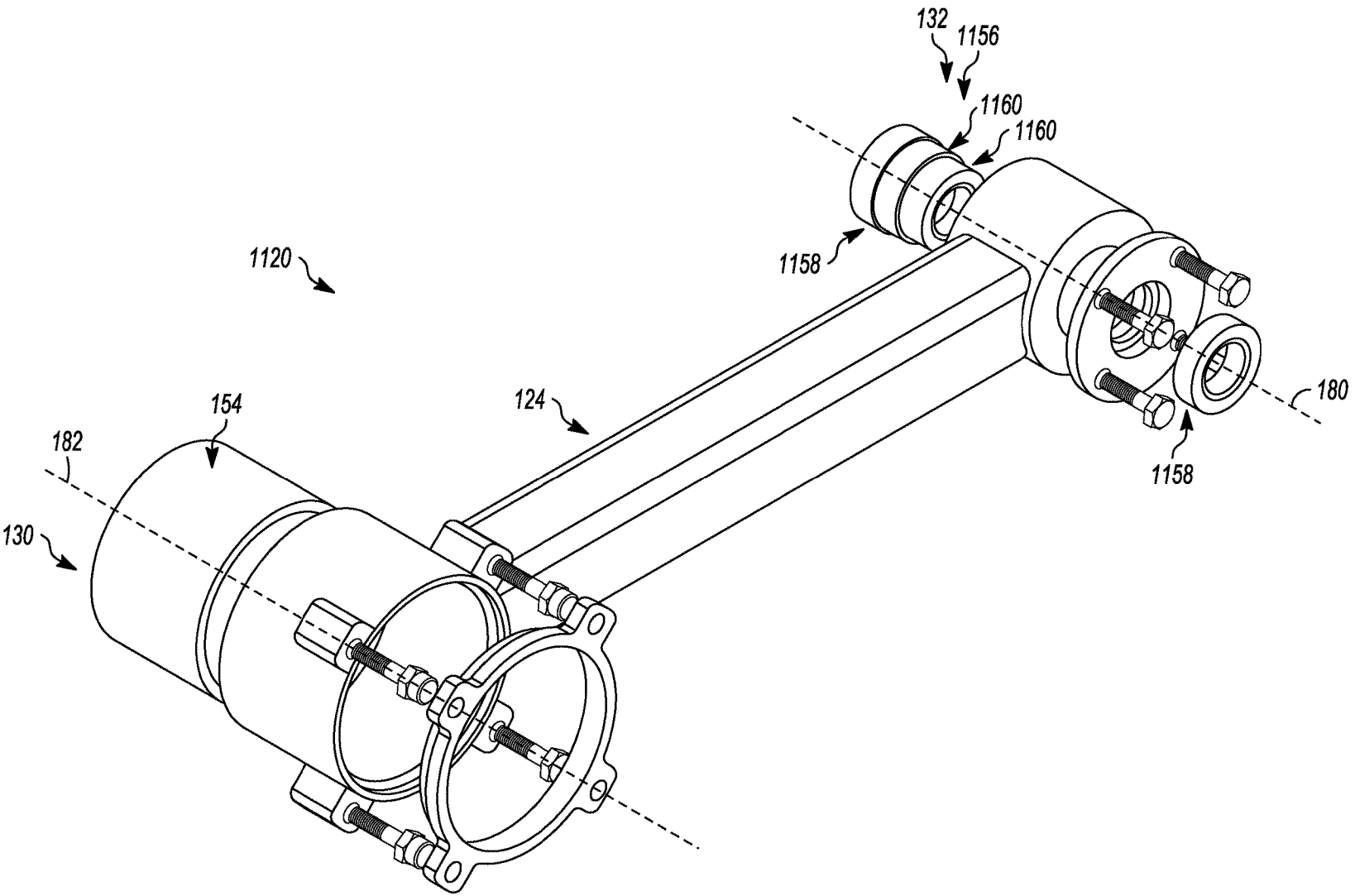
FIG. 11 illustrates an exploded view of a traction rod assembly in accordance with one embodiment.

FIG. 11 illustrates an exploded view of a traction rod assembly 1120 in accordance with another embodiment. Like the traction rod assembly shown in FIG. 6, the traction rod assembly includes the bush assembly 154 disposed at the first end 130 of the body 124 of the traction rod assembly. The traction rod assembly shown in FIG. 11 includes a bearing assembly 1156 that has an alternative configuration than the bearing assembly 156 shown in FIG. 6. In the illustrated embodiment of FIG. 11, the bearing assembly includes two cylindrical bearings 1158, and two spacers 1160 disposed between the two cylindrical bearings 1158. The cylindrical bearings and the spacers are concentric with each other about the bearing axis 180. Unlike the spacers of the bearing assembly 156 shown in FIG. 6, the spacers 1160 are substantially uniform in shape and size, and are positioned between the cylindrical bearings. Alternatively, the bearing assembly may have a single spacer or may have more than two spacers positioned at any location relative to the one or more cylindrical bearings and at any position along the bearing axis.

Figure 12:
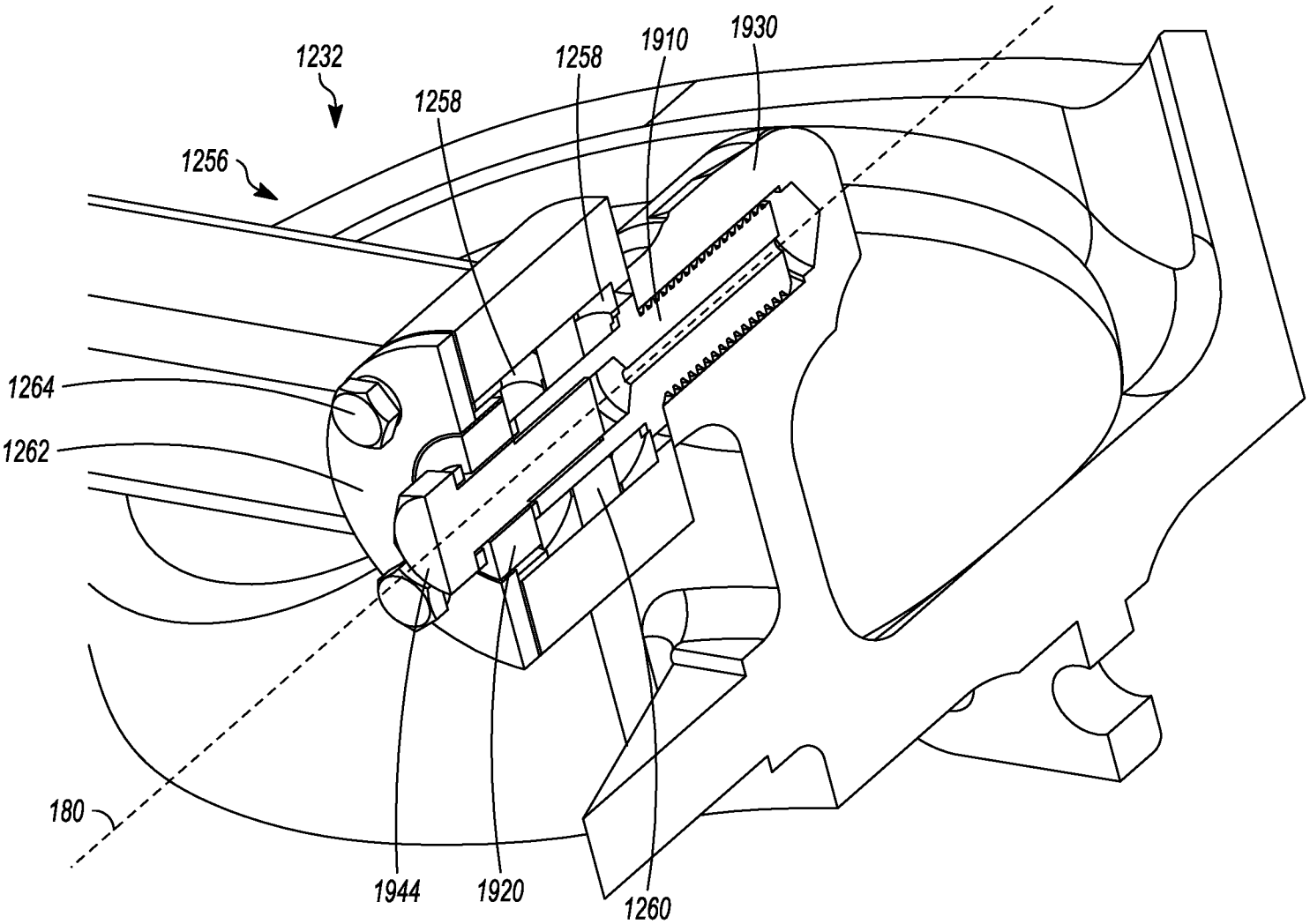
FIG. 12 illustrates a cross-sectional view of a second end of a traction rod assembly in accordance with one embodiment.

FIG. 12 illustrates a cross-sectional view of a second end 1232 of a traction rod assembly coupled with an axle box of a bogie system in accordance with one embodiment. The second end includes a bearing assembly 1256 disposed within a passage of the second end of the traction rod assembly. The bearing assembly includes two cylindrical bearings separated from each other by a spacer 1260. The position of the bearing assembly may be maintained within the passage via one or more assembly components 1262 and/or one or more assembly fasteners 1264. Like the traction rod assembly shown in FIG. 10, the second end of the traction rod assembly may be coupled with a portion 1930 of the axle box of the bogie system via one or more assembly components 1910, 1920, 1944. Alternatively, the second end of the traction rod assembly may be coupled with the axle box of the bogie system via one or more alternative configurations.

In one or more embodiments of the subject matter described herein, a traction rod assembly for a bogie system includes a body extending between a first end and a second end, and a bearing assembly coupled with the second end of the body. The bearing assembly includes cylindrical bearings and one or more spacers disposed between the cylindrical bearings along a bearing axis. The cylindrical bearings and the one or more spaces are concentric with a passage disposed at the second end of the body along the bearing axis. The first end of the body is coupled with a frame of the bogie system, and the bearing assembly is coupled with an axle box of the bogie system. The body is configured to rotate about the bearing axis relative to the axle box of the bogie system.

Optionally, the traction rod assembly may include a bush assembly operably coupled with the first end of the body. The bush assembly may include a first component having a passage extending between a first surface and a second surface of the first component, and a second component disposed within the passage of the first component. The bush assembly may include an eccentric offset such that a center of the first component is offset from a center of the second component.

Optionally, the first component may be manufactured of a metallic material, and the second component may be manufactured of an elastomeric material.

Optionally, the bush assembly may include a third component disposed within a passage of the second component that extends between a first surface and a second surface of the second component. The third component may include a mating interface that is configured to be coupled with a mating component of the frame of the bogie system.

In one or more embodiments, a bogie system may include a bush assembly and a bearing assembly. The bush assembly may be coupled with the frame of the bogie system. The traction rod assembly may reduce an amount of translational movement of the axle box of the bogie system relative to the bush assembly not being coupled with the frame and the bearing assembly not being coupled with the axle box of the bogie system.

Optionally, the bearing assembly and the bush assembly may increase a level of rigidity of the bogie system relative to the first end not being coupled with the frame of the bogie system and the second end of the body not being coupled with the axle box of the bogie system.

Optionally, the traction rod assembly may be a first traction rod assembly, and the bogie system may include plural traction rod assemblies. The first traction rod assembly and a second traction rod assembly may be disposed on a first side of the bogie system, and a third traction rod assembly and a fourth traction rod assembly may be disposed on a second side of the bogie system.

Optionally, the first and second traction rod assemblies may be disposed on the first side of the bogie system at a position outside of the frame of the bogie system, and the third and fourth traction rod assemblies may be disposed on a second side of the bogie system at a position outside of the frame of the bogie system.

In one or more embodiments of the subject matter described herein, a traction rod assembly for a bogie system includes a body extending between a first end and a second end, and a bush assembly operably coupled with the first end of the body. The bush assembly includes a first component having a passage extending between a first surface and a second surface of the first component, and a second component disposed within the passage of the first component. The bush assembly includes an eccentric offset such that a center of the first component is offset from a center of the second component.

Optionally, the bush assembly may be operably coupled with a mating component. A mating axis of the mating component may be offset from the center of the first component and the mating axis of the mating component may be aligned with the center of the second component.

Optionally, the first component may be manufactured of a metallic material and the second component may be manufactured of an elastomeric material.

Optionally, the bush assembly may include a third component disposed within a passage of the second component that extends between a first surface and a second surface of the second component. The third component may include a mating interface that is to be coupled with a mating component of a frame of the bogie system.

Optionally, the traction rod assembly may include a bearing assembly operably coupled with second end of the body. The bearing assembly may include cylindrical bearings and one or more spacers disposed along a bearing axis. The cylindrical bearings and the one or more spacers are concentric with a passage disposed at the second end of the body along the bearing axis. The bearing assembly may be coupled with an axle box of the bogie system and may allow rotation of the body relative to the axle box of the bogie system.

Optionally, the bush assembly may be coupled with a frame of the bogie system.

Optionally, the bearing assembly may allow rotation of the body relative to the axle box of the bogie system, and the bearing assembly and the bush assembly may reduce an amount of translational movement of the axle box relative to the bush assembly not being coupled with the frame of the bogie system and the bearing assembly not being coupled with the axle box of the bogie system.

Optionally, the bearing assembly and the bush assembly may increase a level of rigidity of the bogie system relative to the first end of the body not being coupled with the frame of the bogie system and the second end not being coupled with the axle box of the bogie system.

Optionally, the first end of the body may be operably coupled with a frame of the bogie system and the second end of the body may be operably coupled with an axle box of the bogie system.

In one or more embodiments of the subject matter described herein, a traction rod assembly for a bogie system includes a body extending between a first end and a second end. A bush assembly is operably coupled with the first end of the body. The bush assembly includes a first component having a passage extending between a first surface and a second surface of the first component, and a second component disposed within the passage of the first component. The bush assembly includes an eccentric offset such that a center of the first component is offset from a center of the second component. A bearing assembly is operably coupled with the second end of the body. The bearing assembly includes cylindrical bearings and one or more spacers disposed along a bearing axis. The cylindrical bearings and the one or more spacers are concentric with a passage disposed at the second end of the body along the bearing axis. The bush assembly is operably coupled with a frame of the bogie system and the bearing assembly is operably coupled with an axle box of the bogie system. The bearing assembly allows rotation of the body relative to the axle box of the bogie system.

Optionally, the first component of the bush assembly may be manufactured of a metallic material and the second component of the bush assembly may be manufactured of an elastomeric material.

Optionally, the bearing assembly may allow rotation of the body relative to the axle box of the bogie system, and the bearing assembly and the bush assembly may reduce an amount of translational movement of the axle box relative to the bush assembly not being couple with the frame of the bogie system and the bearing assembly not being coupled with the axle box of the bogie system.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A traction rod assembly for a bogie system, the traction rod assembly comprising:

a body extending between a first end and a second end;

a bush assembly operably coupled with the first end of the body, the bush assembly comprising a first component having a passage extending between a first surface and a second surface of the first component, a second component disposed within the passage of the first component, and a third component disposed within a passage of the second component that extends between a first surface and a second surface of the second component, wherein the third component includes a mating interface that is configured to be coupled with a mating component of the frame of the bogie system, and the bush assembly includes an eccentric offset such that a center of the first component is offset from a center of the second component; and a bearing assembly coupled with the second end of the body, the bearing assembly comprising cylindrical bearings and one or more spacers disposed between the cylindrical bearings along a bearing axis, the cylindrical bearings and the one or more spacers being concentric with a passage disposed at the second end of the body along the bearing axis, wherein the first end of the body is configured to be coupled with a frame of the bogie system, the bearing assembly is configured to be coupled with an axel box of an axle assembly of the bogie system, the bearing axis is offset from an axel of the bogie system in a longitudinal direction, and the body is configured to rotate about the bearing axis relative to the axle assembly of the bogie system.

2. The traction rod assembly of claim 1, wherein the first component is manufactured of a metallic material, and the second component is manufactured of an elastomeric material.

3. A bogie system comprising the traction rod assembly of claim 1, wherein the bush assembly is configured to be coupled with the frame of the bogie system, wherein the traction rod assembly is configured to reduce an amount of translational movement of the axle assembly of the bogie relative to bush assembly not being coupled with the frame and the bearing assembly not being coupled with the axle assembly of the bogie system.

4. The bogie system of claim 3, wherein the bearing assembly and the bush assembly are configured to increase a level of rigidity of the bogie system relative to the first end not being coupled with the frame of the bogie system and the second end of the body not being coupled with the axle assembly of the bogie system.

5. The bogie system of claim 3, wherein the traction rod assembly is a first traction rod assembly, the bogie system further comprising plural traction rod assemblies, wherein the first traction rod assembly and a second traction rod assembly are configured to be disposed on a first side of the bogie system, and wherein a third traction rod assembly and a fourth traction rod assembly are configured to be disposed on a second side of the bogie system.

6. The bogie system of claim 5, wherein the first and second traction rod assemblies are configured to be disposed on the first side of the bogie system at a position outside of the frame of the bogie system, and the third and fourth traction rod assemblies are configured to be disposed on the second side of the bogie system at a position outside of the frame of the bogie system.

7. A traction rod assembly for a bogie system, the traction rod assembly comprising:

a body extending between a first end and a second end, and a bush assembly operably coupled with the first end of the body, the bush assembly comprising:

a first component having a first passage extending between a first surface and a second surface of the first component;

a second component disposed within the passage of the first component, the second component comprising a second passage extending between the first surface and the second surface of the first component; and a third component disposed within the second passage of the second component, the third component comprising a mating surface configured to be coupled with a mating component of the frame of the bogie system, wherein the bush assembly includes an eccentric offset such that a center of the first component is offset from a center of the second component, and the center of the second component is aligned with a center of the third component.

8. The traction rod assembly of claim 7, wherein the bush assembly is configured to be operably coupled with the mating component of the frame of the bogie system, wherein a mating axis of the mating component is configured to be offset from the center of the first component, and the mating axis of the mating component is configured to be aligned with the center of the second component.

9. The traction rod assembly of claim 7, wherein the first component is manufactured of a metallic material, and the second component is manufactured of an elastomeric material.

10. The traction rod assembly of claim 7, further comprising a bearing assembly operably coupled with the second end of the body, the bearing assembly comprising cylindrical bearings and one or more spacers disposed between the cylindrical bearings along a bearing axis, the cylindrical bearings and the one or more spacers being concentric with a passage disposed at the second end of the body along the bearing axis, the bearing assembly is configured to be coupled with an axel box of an axle assembly of the bogie system, wherein the bearing assembly is offset from an axel of the bogie system in a longitudinal direction, and the bearing assembly is configured to allow rotation of the body relative to the axle assembly of the bogie system.

11. A bogie system comprising the traction rod assembly of claim 10, wherein the bush assembly is configured to be coupled with a frame of the bogie system.

12. The bogie system of claim 11, wherein the bearing assembly is configured to allow rotation of the body relative to the axle assembly of the bogie system, and the bearing assembly and the bush assembly are configured to reduce an amount of translational movement of the axle assembly relative to the bush assembly not being coupled with the frame of the bogie system and the bearing assembly not being coupled with the axle assembly of the bogie system.

13. The bogie system of claim 11, wherein the bearing assembly and the bush assembly are configured to increase a level of rigidity of the bogie system relative to the first end of the body not being coupled with the frame of the bogie system and the second end not being coupled with the axle assembly of the bogie system.

14. A bogie system comprising the traction rod assembly of claim 7, wherein the first end of the body is configured to be operably coupled with a frame of the bogie system, and the second end of the body is configured to be operably coupled with an axle assembly of the bogie system.

15. A traction rod assembly for a bogie system, the traction rod assembly comprising:

a body extending between a first end and a second end;

a bush assembly operably coupled with the first end of the body, the bush assembly comprising:

a first component having a passage extending between a first surface and a second surface of the first component; and a second component disposed within the passage of the first component, the second component comprising a second passage extending between the first surface and the second surface of the first component; and a third component disposed within the second passage of the second component, the third component comprising a mating surface configured to be coupled with a mating component of the frame of the bogie system, wherein the bush assembly includes an eccentric offset such that a center of the first component is offset from a center of the second component, and the center of the second component is aligned with a center of the third component; and a bearing assembly operably coupled with the second end of the body, the bearing assembly comprising cylindrical bearings and one or more spacers disposed along a bearing axis, the cylindrical bearings and the one or more spacers being concentric with a third passage disposed at the second end of the body along the bearing axis, wherein the bush assembly is configured to be operably coupled with a frame of the bogie system, and the bearing assembly is configured to be operably coupled with an axle assembly of the bogie system, the bearing assembly is offset from an axle of the bogie system in a longitudinal direction, and the bearing assembly is configured to allow rotation of the body relative to the axle assembly of the bogie system.

16. The traction rod assembly of claim 15, wherein the first component of the bush assembly is manufactured of a metallic material, and the second component of the bush assembly is manufactured of an elastomeric material.

17. The traction rod assembly of claim 15, wherein the bearing assembly is configured to allow rotation of the body relative to the axle assembly of the bogie system, and the bearing assembly and the bush assembly are configured to reduce an amount of translational movement of the axle assembly relative to the bush assembly not being coupled with the frame of the bogie system and the bearing assembly not being coupled with the axle assembly of the bogie system.

* * * * *